US006450132B1

(12) United States Patent
Yao et al.

(10) Patent No.: US 6,450,132 B1
(45) Date of Patent: Sep. 17, 2002

(54) LOOP TYPE HEAT PIPE

(75) Inventors: Akira Yao; Hiroaki Ishikawa; Tetsurou Ogushi; Eiichi Ozaki, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/775,667

(22) Filed: Feb. 5, 2001

(30) Foreign Application Priority Data

Feb. 10, 2000 (JP) ..... 2000-033336

(51) Int. Cl.[7] ..... F28D 15/04
(52) U.S. Cl. ..... 122/366; 165/104.26
(58) Field of Search ..... 122/366; 165/104.25, 165/104.26

(56) References Cited

U.S. PATENT DOCUMENTS 4,765,396 A 8/1988 Seidenberg
4,883,116 A * 11/1989 Seidenberg et al. ..... 122/366
5,076,352 A * 12/1991 Rosenfeld et al. ..... 122/366
5,303,768 A * 4/1994 Alario et al. ..... 122/366
5,335,720 A * 8/1994 Ogushi et al. ..... 122/366
5,725,049 A * 3/1998 Swanson et al. ..... 122/366
6,123,512 A * 9/2000 Benner et al. ..... 417/209

FOREIGN PATENT DOCUMENTS

JP 10 246583 9/1988

* cited by examiner

*Primary Examiner*—Gregory Wilson
(74) *Attorney, Agent, or Firm*—Burns, Doane, Swecker & Mathis, LLP

(57) ABSTRACT

Inner peripheral grooves for transporting a liquid of a working fluid in the longitudinal direction of a first wick are provided along the first wick which transports the liquid contained in the evaporator to a heating portion in the evaporator by capillary force, and a liquid supply portion for supplying the liquid of the working fluid is further provided to the inner peripheral grooves. Therefore, the liquid of the working fluid can be efficiently supplied to the inner peripheral surface of the first wick with a simple structure, so that a loop type heat pipe which can be constantly stably operated can be obtained.

20 Claims, 7 Drawing Sheets

Related Art

LOOP TYPE HEAT PIPE

BACKGROUND OF THE INVENTION

1. Field of the Invention

The present invention relates to a loop type heat pipe which can be used as a space, industrial or domestic heat transport apparatus.

2. Description of the Related Art

Among loop type heat pipes which can be used as a space, industrial or domestic heat transport apparatus, a pipe having the structure which is disclosed in, e.g., Japanese Patent Laid-Open Publication No. Hei 10-246583 has been widely used.

FIG. 6 shows the structure of a conventional loop type heat pipe. In FIG. 6, the loop type heat pipe has such a configuration that an evaporator 1 for applying heat and a condenser 20 for radiating the applied heat are connected by a vapor pipe 9 and a liquid pipe 11. A working fluid is sealed in the evaporator 1, the vapor pipe 9, the condenser 20 and the heat pipe 11. Vapor of the working fluid passes through the vapor pipe 9, and on the other hand, the liquid of the working fluid passes through the liquid pipe 11. It is to be noted that since evaporation latent heat is utilized for heat transport, a fluid having excellent vaporization properties is generally selected as the working fluid. For example, ammonia or alcohol is used as the fluid having the excellent vaporization properties.

Giving a full detail, the evaporator 1 is accommodated in an evaporator container 4. A liquid bank 6 for storing the working fluid therein is provided inside the evaporator 1, and both ends of the liquid band 6 are connected to a liquid supply pipe 17, which is connected to the liquid pipe 11 to supply a liquid 13*a* of the working fluid, and the vapor pipe 9, respectively. Furthermore, a second wick 7 is provided along the outer periphery of the liquid bank 6, and a first wick 2 is provided along the outer periphery of the second wick 7. The second wick 7 transports the liquid of the working fluid to the inner peripheral surface of the first wick 2 by capillary force, and the first wick 2 transports the liquid of the working fluid to the vicinity of the outer periphery of the evaporator 1 by the capillary force.

The vapor from the evaporator 1 passes through the vapor pipe 9 as indicated by an arrow 14, and the vapor 13*b* of the working fluid is supplied to the condenser 20, in which heat is released as indicated by arrows 21. The vapor 13*b* becomes the liquid 13*a* of the working fluid, and this liquid 13*a* passes to the liquid bank 6 through the liquid pipe 11 as indicated by an arrow 16.

FIG. 7 is views showing the cross section (FIG. 7(A)) vertical to the radial direction of the evaporator 1 and the cross section (FIG. 7(B)) vertical to the axial direction of the same in order to illustrate the structure of the evaporator 1 in FIG. 6 in more detail. In FIGS. 7(A) and 7(B), the first wick 2 is provided inside the evaporator container 4 forming the outline of the evaporator 1 through a plurality of projecting portions 26. Further, the second wick 7 is arranged on the inner peripheral surface of the first wick 2. A vapor flow path 25 is provided between the projecting portions 26, and the vapor 13*b* of the working fluid flows through the vapor flow path 25.

It is to be noted that since the first wick 2 and second wick 7 must transport the liquid 13*a* of the working fluid by the capillary force, a porous body having a pore diameter of approximately 0.5 to several tens of $\mu$m is generally used. The pore diameter of the first wick 2 is smaller than that of the second wick 7. The first wick 2 has a function for circulating the working fluid in the loop type heat pipe by generating the high capillary force, and the second wick 7 has a function for distributing the liquid 13*a* of the working fluid in the circumferential direction of the first wick 2.

The second wick 7 does not, therefore, have as high a capillary force as the first wick 2 but has small flow path resistance. Thus, the second wick 7 can transport a large amount of the liquid 13*a* of the working fluid against the weight. A liquid bank 6 capable of storing the liquid 13*a* of the working fluid is provided on the inner periphery of the second wick 7, and the liquid of the working fluid is supplied from the liquid pipe 11 through the liquid supply pipe 17. Further, a vapor pipe 9 for evacuating the vapor 13*b* of the working fluid in the evaporator 1 is provided in the evaporator container 4.

The principle of operation of the conventional loop type heat pipe having the above structure will now be described hereinafter.

In FIG. 7, the liquid 13*a* of the working fluid stored in the liquid bank 6 is first transported in the circumferential direction by the capillary force of the second wick 7 as indicated by the arrow 30. Thereafter, the liquid 13*a* is transported in the radial direction of the first wick 2 by the capillary force of the first wick 2 which is arranged to be in contact with the second wick 7. The flow of heat to be applied at this time is indicated by an arrow. That is, when heat is applied from the outer periphery of the evaporator 1, the applied heat is conducted to the first wick 2 through the peripheral projecting portions 26 arranged between the first wick 2 and the evaporator container 4. The liquid 13*a* of the working fluid is evaporated to become the vapor 13*b* of the working fluid on the outer peripheral surface of the first wick 2 by the conducted heat. The generated vapor 13*b* flows in the vapor flow paths 25 along the direction indicated by an arrow 41 to enter the vapor pipe 9.

As shown in FIG. 6, the vapor 13*b* of the working fluid then flows into the condenser 20. However, since heat radiation is performed in the condenser 20 along the direction indicated by an arrow 21, the inside of the condenser 20 is maintained at a temperature lower than that of the vapor 13*b* of the working fluid. The vapor 13*b* of the working fluid is thus condensed and phase-changed again become the vapor 13*a* of the working fluid. At this time, heat radiation is carried out. Moreover, the phase-changed liquid 13*a* of the working fluid flows in the liquid pipe 11 as indicated by an arrow 16 and is again supplied into the liquid bank 6 through the liquid supply pipe 17.

By repeating the above-described cycle, heat can be transported from the evaporator 1 to the condenser 20.

In the above-mentioned conventional loop type heat pipe, in order to transport the liquid 13*a* of the working fluid to the inner peripheral surface of the first wick 2, the second wick 7 must be used. As the second wick 7, one having a pore diameter larger than that of the first wick 2 is used. Therefore, two types of wick are required, and the two-layer configuration must be employed, thereby leading to complicated manufacture.

Further, as to the liquid existing in the porous body such as a wick, the bubble nucleus which can be the nucleus of boiling generally becomes larger as the pore diameter of the porous body increases. When heated, boiling is apt to occur with a small quantity of heating. Since the second wick 7 has a large pore diameter, it has such a problem that the liquid 13*a* of the working fluid in the wick is readily boiled by applying heat. Therefore, when the liquid 13*a* of the working fluid is boiled in the second wick 7, the liquid 13*a* of the working fluid can not be supplied to the entire inner peripheral surface of the first wick 2 and the working fluid in the loop type heat pipe can not be thereby circulated.

SUMMARY OF THE INVENTION

In order to eliminate the above-described problems, it is an object of the present invention to provide a loop type heat pipe which can be readily manufactured without providing the double structure of the wick 2.

It is another object of the present invention to provide a loop type heat pipe by which the liquid of the working fluid is not boiled in the second wick even if a quantity of heating with respect to the evaporator is increased.

In the loop type heat pipe according to a first aspect of the present invention, grooves for transporting the liquid of the working fluid to the wick in the longitudinal direction of the wick are provided, and a liquid distribution portion for supplying the liquid is provided to the grooves. By adopting such a structure, the loop type heat pipe can be stably operated with a simple structure.

The loop type heat pipe according to a second aspect of the present invention has a liquid distribution structure for supplying the liquid to all the grooves. Adopting such a structure enables the liquid to be stably supplied to the entire inner peripheral surface of the wick without causing partial liquid distribution in the vertical direction of the evaporator.

The loop type heat pipe according to a third aspect of the present invention supplies the liquid to all the grooves by using flow paths in which the liquid flows. By adopting such a structure, the liquid can be stably supplied to the entire inner peripheral surface of the wick without causing partial liquid distribution in the vertical direction of the evaporator, and the liquid can be supplied to all the grooves with a simple structure.

The loop type heat pipe according to a fourth aspect of the present invention supplies the liquid to all the grooves by using pipes in which the liquid flows. By adopting such a structure, the liquid can be stably supplied to the entire inner peripheral surface of the wick without causing partial liquid distribution in the vertical distribution of the evaporator, and the liquid can be reliably supplied to all the grooves.

The loop type heat pipe according to a fifth aspect of the present invention has a liquid distribution structure for supplying the liquid to part of the grooves. Adopting such a structure enables the liquid to be efficiently supplied to the inner periphery of the wick.

The loop type heat pipe according to a sixth aspect of the present invention has a flow path in which the fluid can flow and supplies the liquid to part of the grooves by using this flow path. When such a structure is employed, the liquid can be supplied to an arbitrary groove by the simple structure.

The loop type heat pipe according to a seventh aspect of the present invention uses a pipe in which the liquid flows to supply the liquid to part of the grooves. Adopting such a structure enables the liquid to be reliably supplied to an arbitrary groove.

BRIEF DESCRIPTION OF THE INVENTION

DESCRIPTION OF THE PREFERRED EMBODIMENTS

Embodiment 1

Figure 1B:
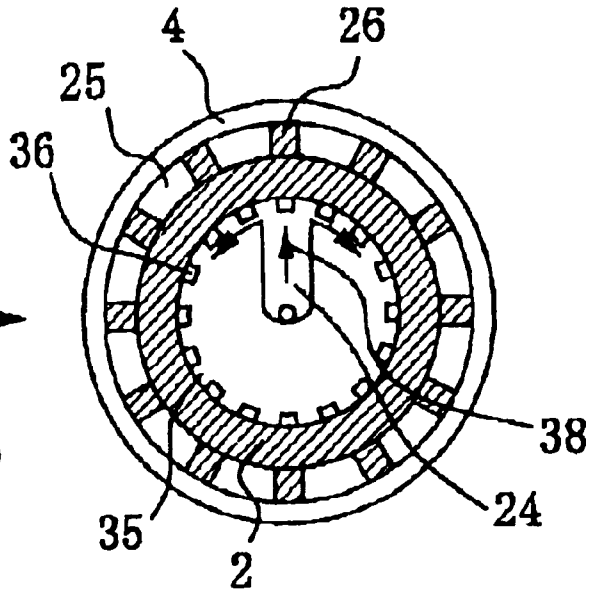
FIG. 1(B) is a cross-sectional view of a loop type heat pipe according to the embodiment 1 of the present invention, viewed from an axial direction of the evaporator.
Figure 1A:
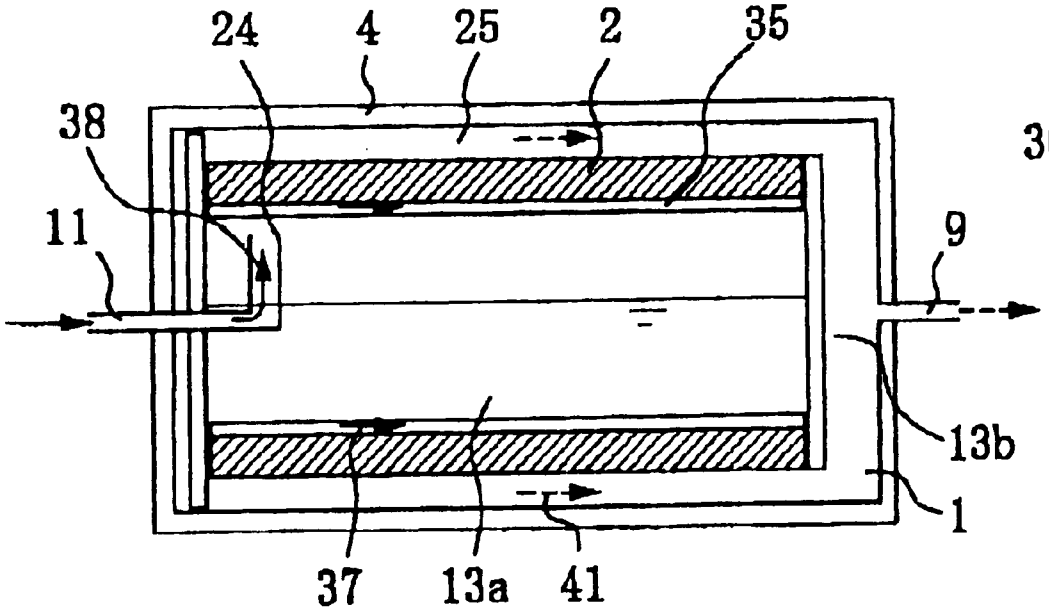
FIG. 1(A) is a cross-sectional view of a loop type heat pipe according to an embodiment 1 of the present invention, viewed along an axial direction of an evaporator.

FIG. 1 shows a loop type heat pipe in an embodiment 1 according to the present invention. FIG. 1(A) shows its cross section along an axial direction of an evaporator 1, and FIG. 1(B) shows the cross section along a radial direction of the evaporator 1. It is to be noted that some reference numerals denote constituent parts equal to those of the conventional loop type heat pipe.

As shown in FIGS. 1(A) and 1(B), the evaporator 1 of the loop type heat pipe is accommodated in an evaporator container 4. A liquid bank 6 for storing the working fluid is provided inside the evaporator 1, and both ends of the liquid bank 6 are connected to a liquid pipe 11 in which a liquid 13*a* of the working fluid flows and a vapor pipe 9 in which vapor 13*b* of the working fluid flows. Further, a first wick 2 is provided to the outer periphery of the liquid bank 6, and the first wick 2 transports the liquid of the working fluid to the vicinity of the evaporator 1 using capillary force. Further, inner peripheral projecting portions 36 are provided on the inner surface of the first wick 2, and inner peripheral grooves 35 are formed between the inner peripheral projecting portions 36. On the other hand, a liquid distribution portion 24 is connected to the end of the liquid pipe 11, and this liquid distribution portion 24 is a circular pipe for supplying the liquid 13*a* of the working fluid into the inner peripheral grooves 35. In addition, outer peripheral projecting portions 26 are arranged between the evaporator container 4 and the evaporator 1, and outer peripheral grooves 25 are formed between the outer peripheral projecting portions 26.

In FIG. 1, the first wick 2 is provided in the evaporator container 4 forming the outline of the evaporator 1 through a plurality of outer peripheral projecting portions 26, and a second wick 7 is arranged on the inner peripheral surface of the first wick 2. Vapor flow paths 25 are provided between the outer peripheral projecting portions 26, and the vapor 13b of the working fluid flows in the vapor flow paths 25.

It is to be noted that the outer peripheral projecting portions 26 may have such a structure that they are integrated with the first wick 2 or the evaporator container 4 by using the same member. Additionally, since the first wick 2 must transport the liquid 13*a* of the working fluid by the capillary force, a porous body having a pore diameter of approximately 0.5 to several tens of $\mu$m is generally used. The first wick 2 has a function for circulating the working fluid in the loop type heat pipe by generating high capillary force. The liquid bank 6 for storing the liquid 13*a* of the working fluid is provided to the inner peripheral portion of the first wick 2, and the liquid of the working fluid is supplied from the liquid pipe 11 through a liquid supply pipe 17. Further, the vapor pipe 9 for evacuating the vapor 13*b* of the working fluid in the evaporator 1 is provided to the evaporator container 4.

In the inner peripheral grooves 35 formed on the inner peripheral surface of the first wick 2, the liquid 13*a* of the working fluid is held in the grooves between the adjacent inner peripheral projecting portions 36 by surface tension to be supplied in the longitudinal direction of the first wick 2.

It is to be noted that the inner peripheral projecting portions 36 may be also integrated with the first wick 2 by using the same member as similar to the outer peripheral projecting portions 26.

The principle of operation of the loop type heat pipe having the above-described structure will now be described hereinafter.

In FIG. 1, the liquid 13*a* of the working fluid which has entered the evaporator 1 from the liquid pipe 11 flows through the inside of the liquid distribution portion 24 which is a lead pipe and is supplied to the inner periphery of the first wick 2. The liquid 13 a is then transported in the radial direction of the evaporator 1 by the capillary force of the first wick 2. At this time, when heat is applied to the evaporator 1, the applied heat is conducted from the evaporator container 4 to the first wick 2 through the outer peripheral projecting portions 26 arranged between the first wick 2 and the evaporator container 4.

Figure 6:
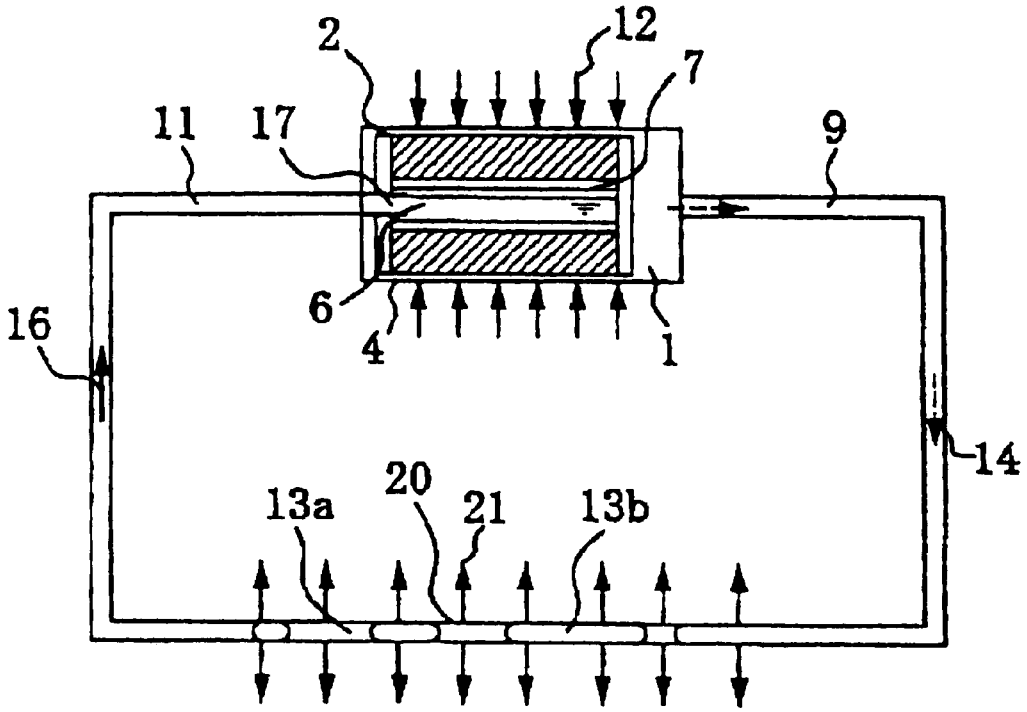
Fig. 6 Related Art
FIG. 6 is a schematic view showing a conventional loop type heat pipe.
Figure 7B:
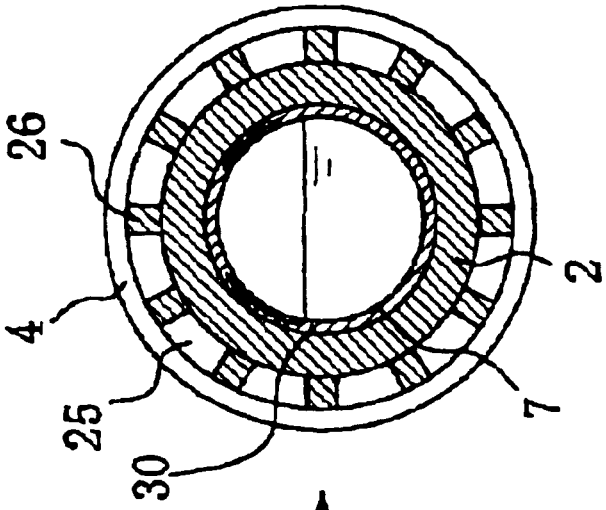
FIG. 7(B) is a cross-sectional view of the conventional loop type heat pipe, viewed from a direction vertical to an axial direction of an evaporator.
Figure 7A:
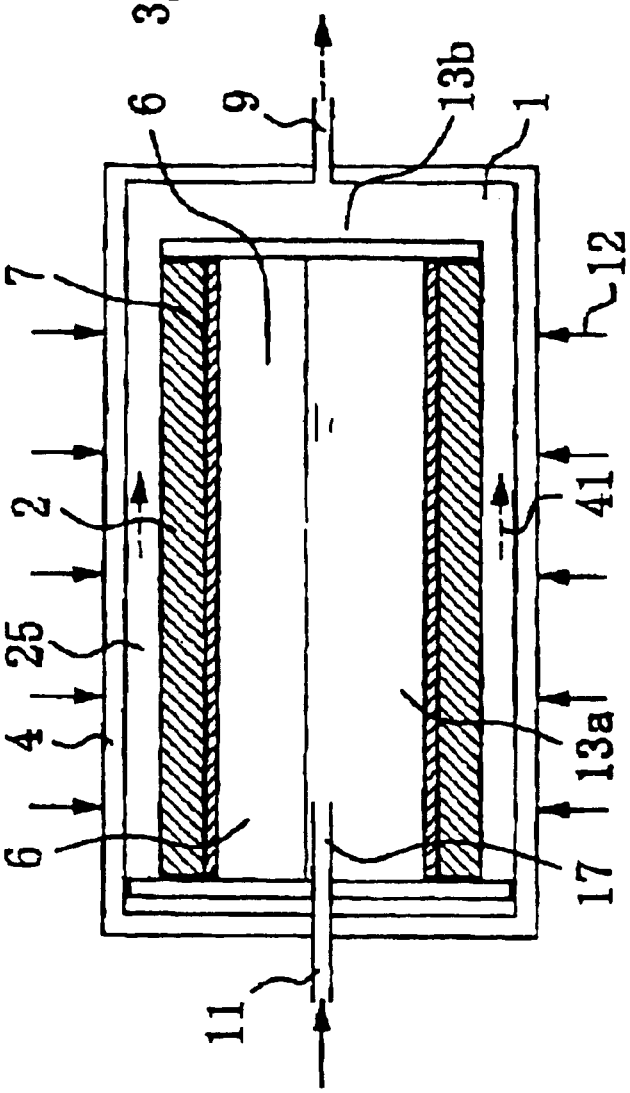
FIG. 7(A) is a cross-sectional view of the conventional loop type heat pipe, viewed along an axial direction of an evaporator.

The conducted heat causes evaporation of the liquid 13*a* of the working fluid so that the liquid 13*a* becomes the vapor 13*b* of the working fluid. The generated vapor 13*b* flows through the outer peripheral grooves 25 in a direction indicated by an arrow 41 to enter the vapor pipe 9. Thereafter, as shown in the above-described FIG. 6, the vapor 13*b* of the working fluid is condensed in the condenser 20 and again phase-changed into the vapor 13*a* of the working fluid. It is then supplied into the evaporator 1 through the liquid distribution portion 24.

The liquid distribution portion 24 consisting of a lead pipe is arranged in such a manner that the liquid 13*a* of the working fluid is supplied toward only the upper inner peripheral grooves 35. Only the upper grooves among the inner peripheral grooves 35 of the first wick 2 are, therefore, filled with the liquid 13*a* of the working fluid at first.

However, when the liquid 13*a* of the working fluid which exceeds an amount that can be held by surface tension is supplied to the inner peripheral grooves 35, the liquid 13*a* of the working fluid flows over from the upper grooves and the liquid 13*a* of the working fluid is supplied to the grooves sequentially from the upper part to the lower part. The liquid 13*a* of the working fluid supplied to each inner peripheral groove 35 flows in the longitudinal direction of the first wick 2 as indicated by an arrow 37, and the liquid 13*a* of the working fluid can then be supplied to the entire inner peripheral surface of the first wick 2 impartially. Adopting the above-described structure enables the liquid 13*a* of the working fluid to be reliably supplied to in the inner peripheral grooves 35.

Figure 2B:
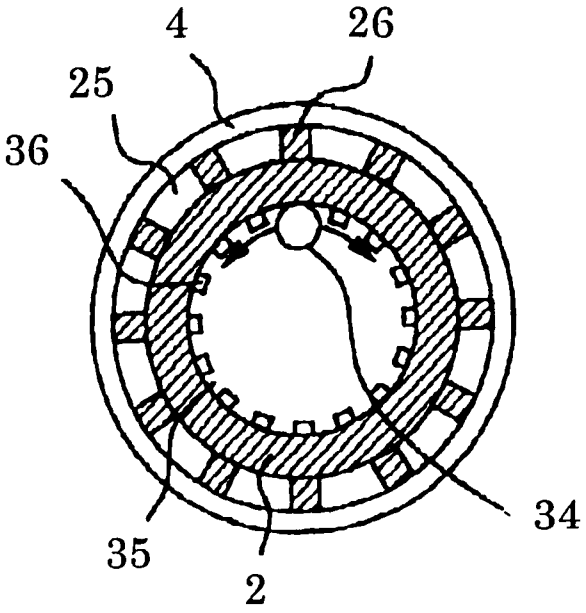
FIG. 2(B) is a cross-sectional view of a liquid distribution portion in the first embodiment according to the present invention, viewed from a direction vertical to an axial direction of the evaporator of the loop type heat pipe according to another example.
Figure 2A:
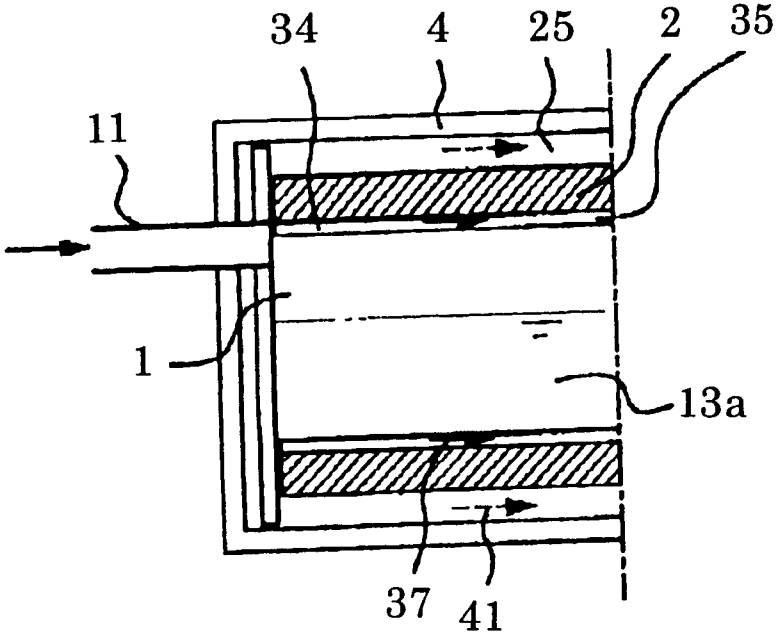
FIG. 2(A) is a cross-sectional view of a liquid distribution portion in the first embodiment according to the present invention, viewed along an axial direction of an evaporator of a loop type heat pipe according to another example.

FIG. 2 are views for explaining another example of the liquid distribution portion in this embodiment. In FIG. 2, a liquid distributor 34 comprises one pipe. Incidentally, FIG. 2(A) shows the cross section vertical to the radial direction of the evaporator 1, and FIG. 2(B) shows the cross section vertical to the axial direction of the evaporator 1. Further, similar reference numerals denote constituent parts similar to those of the loop type heat pipe of the above-described embodiment according to the present invention, and so repeat description thereof is omitted.

As shown in FIG. 2, when one liquid distribution portion 34 is arranged to the upper part of the inner peripheral grooves 35 of the first wick 2, the liquid 13*a* of the working fluid can be supplied in the longitudinal direction of the wick. The liquid 13*a* of the working fluid supplied in the inner peripheral grooves 35 flows in the longitudinal direction of the first wick 2 as indicated by an arrow 37 as similar to FIG. 1 and is then supplied to the entire inner peripheral surface of the first wick 2. By supplying the liquid 13*a* of the working fluid in the longitudinal direction of the inner peripheral grooves 35 by the liquid distribution portion 34, the liquid 13*a* of the working fluid can be more reliably transferred into the inner peripheral grooves 35 than in the case of FIG. 1.

Figure 3B:
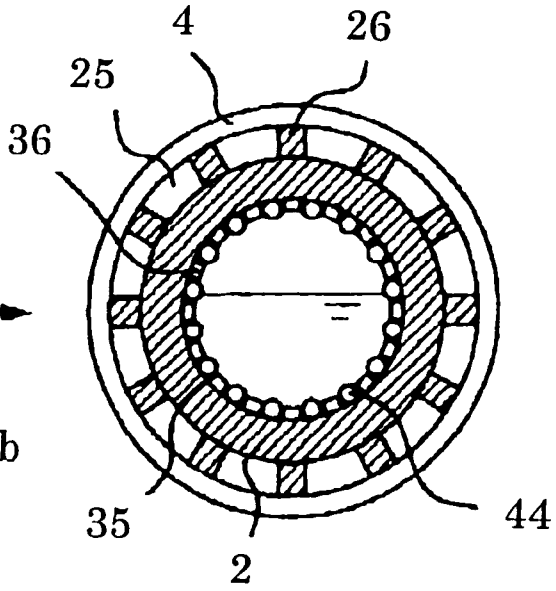
FIG. 3(B) is a cross-sectional view of a liquid distribution portion in the first embodiment according to the present invention, viewed from a direction vertical to an axial direction of the evaporator of the loop type heat pipe according to still another example.
Figure 3A:
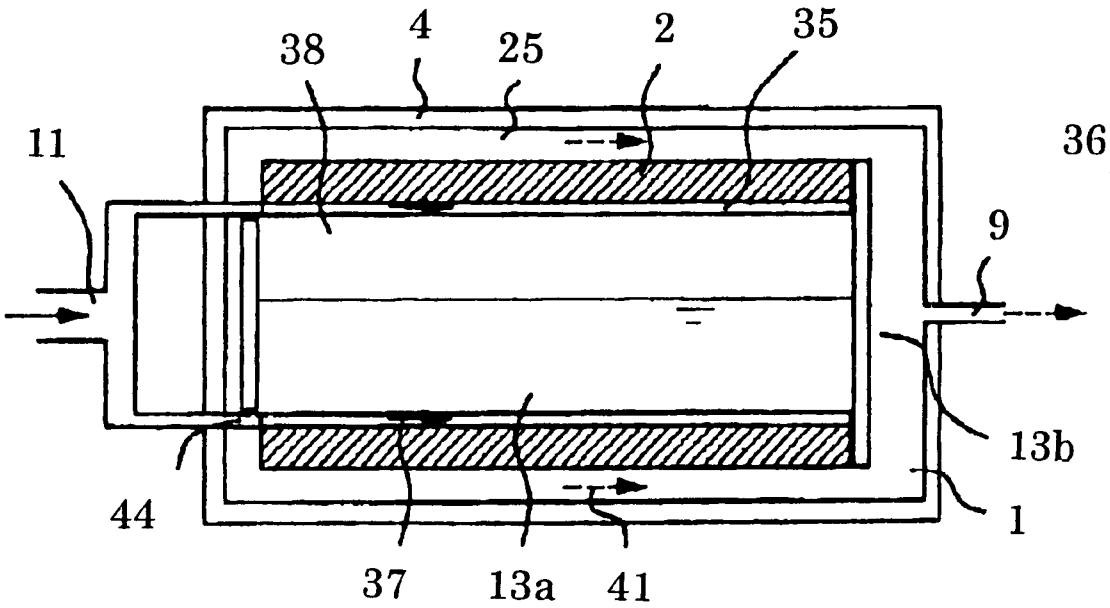
FIG. 3(A) is a cross-sectional view of a liquid distribution portion in the first embodiment according to the present invention, viewed along an axial direction of an evaporator of a loop type heat pipe according to still another example.

FIG. 3 are views for explaining still another example of the liquid distribution portion in this embodiment. Incidentally, FIG. 3(A) shows the cross section vertical to the radial direction of the evaporator 1, and FIG. 3(B) shows the cross section vertical to the axial direction of the evaporator 1. Further, similar reference numerals denote constituent parts that are the same as those of the loop type heat pipe of the above-mentioned embodiment 1 according to the present invention, and so repeat description thereof is omitted.

In FIG. 3, the liquid distributor 44 is constituted by a plurality of pipes branched off from the liquid pipe 11 in such a manner that the liquid can be distributed to each of the inner peripheral grooves 35 of the first wick 2, and they are inserted toward the axial direction of the first wick 2. The liquid 13*a* of the working fluid is therefore split by the liquid distribution portion 44 to be directly led into each winner peripheral groove 35 when flowing into the evaporator 1 from the liquid pipe 11. The liquid 13*a* of the working fluid led into the inner peripheral grooves 35 flows in the longitudinal direction of the first wick 2 as indicated by the arrow 37 as similarly to FIG. 1. As a result, the liquid 13*a* of the working fluid can be supplied to the entire inner peripheral surface of the first wick 2.

It is to be noted that, in the structure shown in FIGS. 1 and 2, the liquid 13*a* of the working fluid is supplied to only the upper inner peripheral grooves 35 and the liquid 13*a* is hence partially supplied in the vertical direction to some extent in the evaporator 1. It can therefore be considered that supply of the liquid 13*a* of the working fluid into the inner peripheral grooves 35 depends on the arrangement of the evaporator 1. Thus, by adopting this structure that the liquid distribution portion 44 is inserted into all the inner peripheral grooves 35, the liquid 13*a* in the evaporator 1 can be substantially evenly maintained without causing vertical partiality, and the liquid 13*a* of the working fluid can be reliably supplied to the entire inner periphery of the first wick 2.

Further, although FIG. 3 shows an example where the liquid distribution portion 44 is inserted into all the inner peripheral grooves 35, the liquid distribution portion 44 does not have to be inserted into all of the inner peripheral grooves 35 as long as the liquid 13*a* of the working fluid can be efficiently supplied to the inner periphery of the first wick 2. In addition, any number of pipes can be used as the liquid distribution portion 44. Moreover, a flow distribution of the liquid 13*a* of the working fluid supplied to each inner peripheral groove 35 can take any form as long as the liquid 13*a* of the working fluid can be efficiently supplied to all the inner peripheries of the first wick 2. In addition, any number of pipes can be used as the liquid distribution portion 44. Moreover, a flow distribution of the liquid 13*a* of the working fluid supplied to each inner peripheral groove 35 can take any form as long as the liquid 13*a* of the working fluid can be efficiently supplied to the all the inner peripheries of the first wick 2.

Further, although one or multiple circular pipes are used as the liquid distribution portion 44 in this embodiment, any pipe can be adopted if this portion has a pipe form. It is needless to say that the circular pipe does not have to be used.

Embodiment 2

Figure 4B:
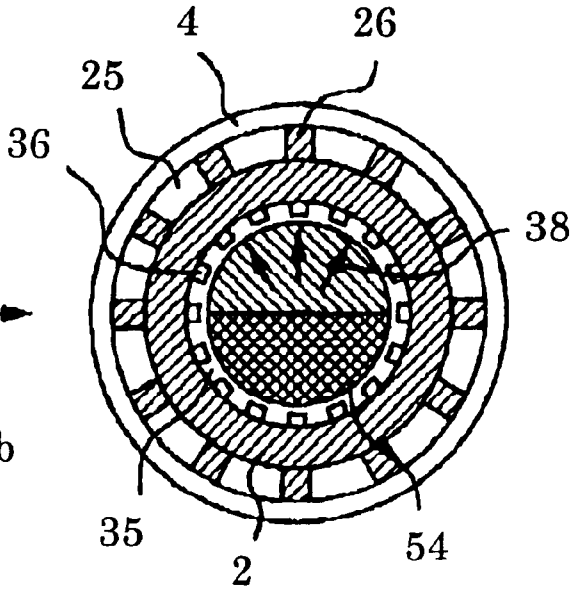
FIG. 4(B) is a cross-sectional view of a loop type heat pipe according to the embodiment 2 of the present invention, viewed from a direction vertical to an axial direction of the evaporator.
Figure 4A:
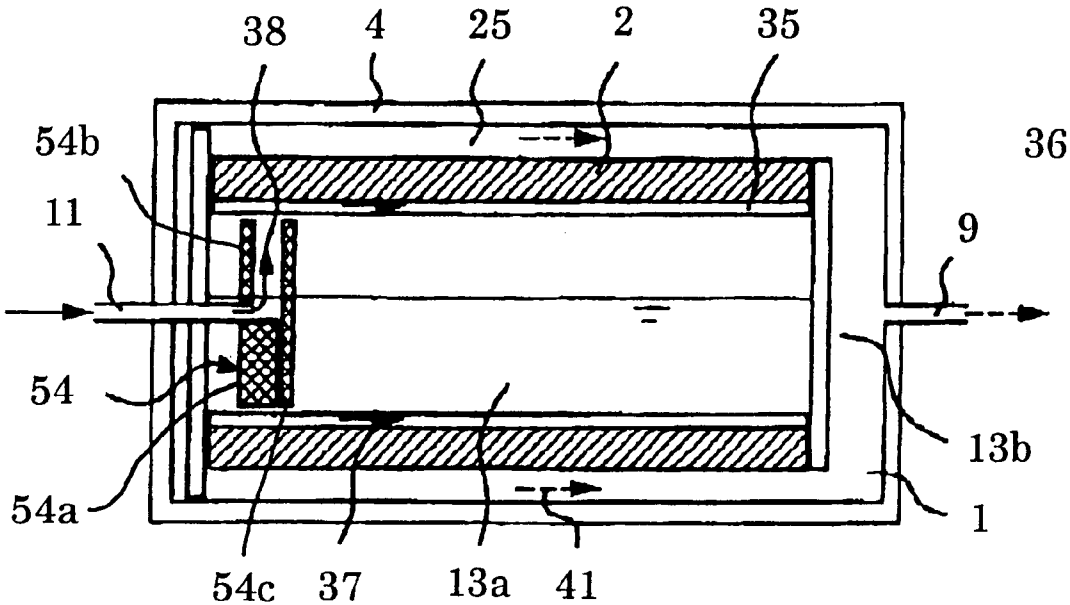
FIG. 4(A) is a cross-sectional view of a loop type heat pipe according to an embodiment 2 of the present invention, viewed along an axial direction of an evaporator.

FIG. 4 is views for explaining a loop type heat pipe according to an embodiment 2 of the present invention. It is to be noted that FIG. 4(A) shows the cross section vertical to the radial direction of the evaporator 1 and FIG. 4(B) shows the cross section vertical to the axial direction of the evaporator 1. Similar reference numerals denote constituent parts the same as those in the loop type heat pipe of the above-described embodiment 1 according to the present invention, thereby avoiding tautological explanation.

The structure similar to that in the embodiment 1 is used except the configuration of the liquid distribution portion 54. In FIG. 4, the liquid distribution portion 54 is constituted by semicircular plates 54*a* and 54*b* which are connected to the liquid pipe 11 and arranged in the vertical direction of the liquid pipe 11 and a circular plate 54*c* provided on the downstream side at a predetermined interval from the semicircular plates 54*a* and 54*b*. The semicircular plate 54*a* and 54*b* and the circular plate 54*c* are arranged with a small gap therebetween. The thickness of the semicircular plate 54*a* in the axial direction of the evaporator 1 is larger than that of the semicircular plate 54*b*. The liquid 13*a* of the working fluid flows between the semicircular plates 54*a* and 54*b*. Although the liquid 13*a* of the working fluid supplied to such a flow path usually flows only in a direction of the lower semicircular plate 54*a* of the liquid distribution portion 54 by the gravitational force, the flow resistance of the working fluid 13*a* flowing downwards becomes large by making the gap between the lower semicircular plate 54*a* and the circular plate 54*c* of the liquid distribution portion 54 narrower than the gap between the upper semicircular plate 54*b* and the circular plate 54*c* as shown in FIG. 5. That is, the liquid can be also supplied to the upper portion.

In this manner, by changing the width of the gap of the liquid distribution portion 54 at an arbitrary part of the liquid distribution portion 54, the liquid 13*a* of the working fluid can be supplied toward the radial direction of the inner peripheral grooves 35 of the first wick 2 in an arbitrary distribution state. The liquid 13*a* of the working fluid evenly supplied into the inner peripheral grooves 35 flows in the longitudinal direction of the first wick 2 as indicated by the arrow 37 as similar to the embodiment 1 and is conducted to the adjacent inner peripheral grooves 35 while flowing. Finally, it is supplied to the entire inner periphery of the first wick 2.

Figure 5B:
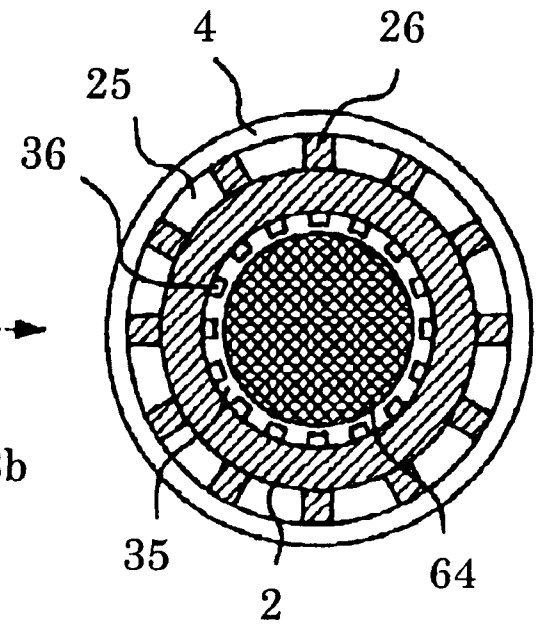
FIG. 5(B) is a cross-sectional view of a liquid distribution portion in the second embodiment according to the present invention, viewed from a direction vertical to an axial direction of the evaporator of the loop type heat pipe according to yet another example.
Figure 5A:
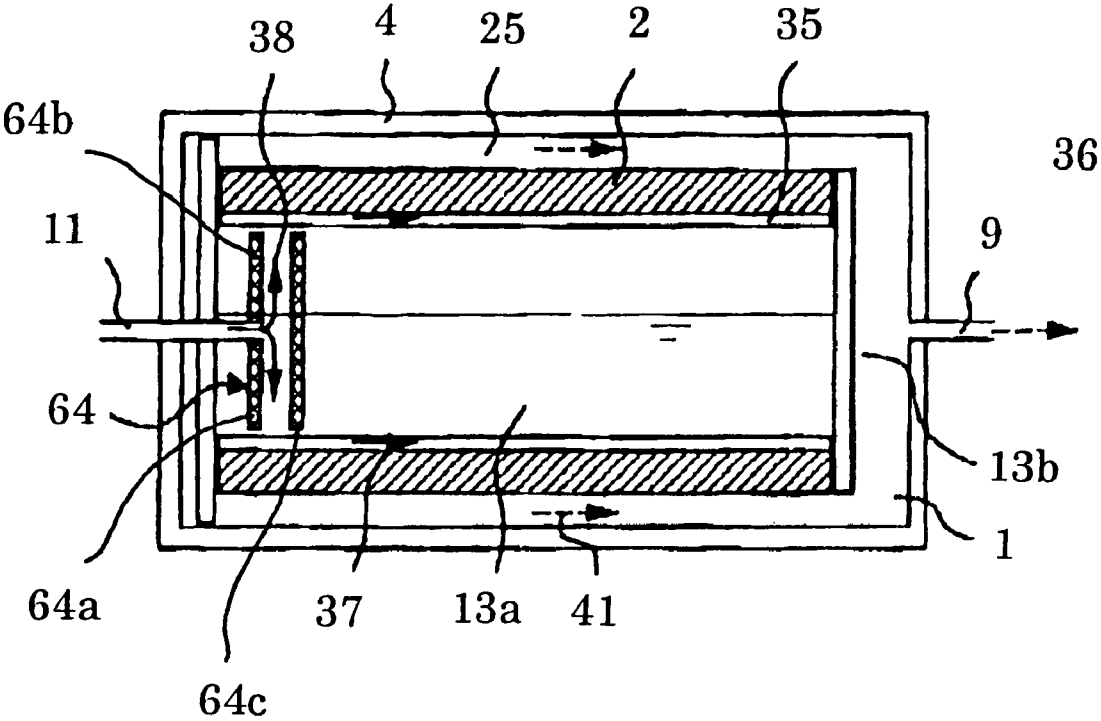
FIG. 5(A) is a cross-sectional view of a liquid distribution portion in the second embodiment according to the present invention, viewed along an axial direction of an evaporator of a loop type heat pipe according to yet another example.

FIG. 5 is views for explaining another example of the liquid distribution portion of the loop type heat pipe in the embodiment 2 according to the present invention. It is to be noted that FIG. 5(A) shows the cross section vertical to the radial direction of the evaporator 1 and FIG. 5(B) shows the cross section vertical to the axial direction of the evaporator 1. Similar reference numerals denote constituent parts the same as those of the loop type heat pipe of the above-described embodiment 1 according to the present invention, and repeat description thereof is omitted.

As shown in FIG. 5, the liquid distribution portion 64 is constituted by semicircular plates 64*a* and 64*b* which are connected to the liquid pipe 11 and arranged in the vertical direction of the liquid pipe 11 and a circular plate 64*c* provided to the downstream side at a predetermined interval from the semicircular plates 64*a* and 64*b*. The semicircular plates 64*a* and 64*b* and the circular plate 64*c* are arranged with a narrow gap therebetween, and the working fluid 13*a* flows between the semicircular plates 64*a* and 64*b*.

Here, as shown in FIG. 5, the thicknesses of the semicircular plates 64*a* and 64*b* relative to the axial direction of the evaporator 1 are substantially equal. Although the liquid 13*a* of the working fluid supplied to such a flow path usually flows to only the lower part of the liquid distribution portion 64 by the gravitational force, the liquid 13*a* of the working fluid flowing between the semicircular plates 64*a* and 64*b* have the flowage resistance which is larger than the gravitational force since the gap between the both semicircular plates 64*a* and 64*b* and the circular plate 64*c* is extremely small. The liquid 13*a* of the working fluid is, therefore, evenly supplied toward the radial direction of the liquid distribution portion 64.

As described above, by forming the gap of the liquid distribution portion 64 extremely narrow, the liquid 13*a* of the working fluid can be evenly supplied in the radial direction of the inner peripheral groove 35 of the first wick 2. The liquid 13*a* of the working fluid evenly supplied in the inner peripheral grooves 35 flows in the longitudinal direction of the first wick 2 as indicated by the arrow 37, similar to the embodiment 1. As a result, it is supplied to the entire inner periphery of the first wick 2.

It is to be noted that although the liquid distribution portion 64 consists of two circular plates in this embodiment, it does not have to be constituted by two circular plates as long as the flow path structure in which the liquid 13 of the working fluid can flow is provided. Further, in the above-mentioned structure shown in FIG. 4, since the liquid 13*a* of the working fluid is supplied to the upper inner peripheral grooves 35, partial supply of the liquid 13*a* of the working fluid is not caused in the vertical direction in the evaporator 1, and the liquid 13*a* of the working fluid can be supplied to all the inner peripheries of the first wick 2. By adopting this embodiment, the liquid 13*a* of the working fluid can be supplied to the inner peripheral grooves 35 with a simpler structure than that of the embodiment 1.

According to the present invention, the wick does not have to adopt the double layer structure and can be thereby readily manufactured. Even if a quantity of heating relative to the evaporator is increased, the liquid of the working fluid is not boiled in the second wick, and the liquid of the working fluid can be constantly stably supplied to the entire inner periphery of the first wick.

That is, the loop type heat pipe can be stably operated with a simple structure.

What is claimed is:

1. A loop type heat pipe having an evaporator for heating a liquid into vapor, a condenser for cooling said vapor to return to said liquid, a vapor pipe for allowing said vapor from said evaporator to flow to said condenser, and a liquid pipe for allowing said liquid from said condenser to flow to said evaporator, said loop type heat pipe comprising:

a heating portion provided in said evaporator;

a wick which is provided in said evaporator and transports said liquid to said heating portion by capillary force;

at least one groove which is formed on the inner surface of said wick along the longitudinal direction of said evaporator to transport said liquid to said wick; and a supply portion which is connected to said liquid pipe and supplies said liquid to said groove.

2. The loop type heat pipe according to claim 1, wherein said supply portion comprises a plurality of liquid supply flow paths which are branched off from said liquid pipe and capable of supplying said liquid to all of said grooves.

3. The loop type heat pipe according to claim 2, wherein said liquid supply flow paths are a plurality of liquid supply flow paths which correspond to the respective groove in one-to-one relation.

4. The loop type heat pipe according to claim 2, wherein said liquid supply flow path comprises a pipe.

5. The loop type heat pipe according to claim 1, wherein said supply portion comprises a liquid supply flow path for supplying said liquid to part of said grooves.

6. The loop type heat pipe according to claim 5, wherein said liquid supply flow path is a flow path for supplying said liquid toward said grooves positioned on the upper side of said evaporator.

7. The loop type heat pipe according to claim 5, wherein said liquid supply flow path is at least one flow path provided on the upper side of said evaporator.

8. The loop type heat pipe according to claim 6, wherein said liquid supply flow path is a pipe.

9. The loop type heat pipe according to claim 7, wherein said liquid supply flow path is a pipe.

10. The loop type heat pipe according to claim 1, wherein said liquid supply path comprises two upper and lower boards connected to said liquid pipe and a partition board arranged in the downstream direction of said two upper and lower boards, and said two upper and lower boards and said partition board are arranged with a narrow gap therebetween.

11. The loop type heat pipe according to claim 10, wherein said evaporator has a cylindrical form, said wick has a hollow cylindrical form, said grooves are provided on the inner peripheral surface of said wick, said two upper and lower boards are semicircular plates, and said partition board is a circular plate.

12. The loop type heat pipe according to claim 10, wherein the thickness of said lower board is larger than that of said upper board.

13. The loop type heat pipe according to claim 10, wherein the thicknesses of said two upper and lower boards are uniform.

14. The loop type heat pipe according to claim 13, wherein a gap between said two upper and lower boards and said partition plate is extremely narrow.

15. The loop type heat pipe according to claim 1, wherein the wick is cylindrical.

16. The loop type heat pipe according to claim 15, further comprising a plurality of additional grooves formed on the inner surface of the wick, wherein the at least one groove and the plurality of additional grooves are evenly spaced about the inner surface of the wick.

17. A method of evaporating liquid in a loop type heat pipe having an evaporator, a condenser, a vapor pipe connecting the evaporator to the condensor, and a liquid pipe connecting the condensor to the evaporator, the evaporator includes a cylindrical wick extending longitudinally therein and having a plurality of grooves extending longitudinally along an inner surface of the wick, the method comprises:

supplying liquid from the liquid pipe to the grooves of the inner surface of the wick;

wicking the liquid from the inner surface to an outer surface of the wick; and evaporating the liquid at the outer surface of the wick.

18. A method of evaporating liquid in a loop type heat pipe having an evaporator, a condenser, a vapor pipe connecting the evaporator to the condensor, and a liquid pipe connecting the condenser to the evaporator, the evaporator includes a cylindrical wick extending longitudinally therein and having a plurality of grooves extending longitudinally along an inner surface of the wick, the method comprises:

supplying liquid from the liquid pipe to a portion of the grooves that are formed on an upper portion of the inner surface of the wick;

wicking the liquid from the inner surface to an outer surface of the wick; and evaporating the liquid at the outer surface of the wick.

19. The method of claim 18, wherein the liquid flows longitudinally along the grooves.

20. The method of claim 18, wherein the liquid flows from the grooves in the upper portion of the inner surface of the wick to a portion of the grooves that are formed in a lower portion of the inner surface of the wick.

* * * * *